United States Patent [19]

Holzer

[11] Patent Number: 4,836,543

[45] Date of Patent: Jun. 6, 1989

[54] TENNIS RACQUET FRAME

[76] Inventor: Walter Holzer, Drosteweg 19, D-7758 Meersburg, Fed. Rep. of Germany

[21] Appl. No.: 214,869

[22] PCT Filed: Dec. 5, 1984

[86] PCT No.: PCT/EP84/00389

§ 371 Date: Oct. 2, 1985

§ 102(e) Date: Oct. 2, 1985

[87] PCT Pub. No.: WO85/02548

PCT Pub. Date: Jun. 20, 1985

Related U.S. Application Data

[63] Continuation of Ser. No. 767,287, Oct. 2, 1985, abandoned.

[30] Foreign Application Priority Data

Dec. 5, 1983 [DE] Fed. Rep. of Germany ..... 3343945
Mar. 5, 1984 [DE] Fed. Rep. of Germany ..... 3416377

[51] Int. Cl.[4] ..... A63B 49/10

[52] U.S. Cl. ..... 273/73 C; 273/73 F; 273/73 D

[58] Field of Search ..... 273/73 R, 73 C, 73 D, 273/73 F, 73 G, 73 H, 73 J, 73 K; 428/116; 52/260; 38/172

[56] References Cited

U.S. PATENT DOCUMENTS

| | | | |
|---|---|---|---|
| 1,387,809 | 8/1921 | Simons | 138/115 |
| 1,452,803 | 4/1923 | Harris | 273/73 H |
| 3,625,512 | 12/1971 | Latham | 273/73 H X |
| 3,840,230 | 10/1974 | Schaefer et al. | 273/73 C X |
| 4,194,738 | 3/1980 | Inoue et al. | 273/73 C |
| 4,280,699 | 7/1981 | Drake | 273/73 C |
| 4,331,331 | 5/1982 | Rodgers, Jr. | 273/73 G |
| 4,365,806 | 12/1982 | Reid et al. | 273/73 C |
| 4,506,887 | 3/1985 | Trysinsky | 273/73 C |

FOREIGN PATENT DOCUMENTS

| | | | |
|---|---|---|---|
| 2621062 | 12/1976 | Fed. Rep. of Germany | 273/73 G |
| 800262 | 4/1936 | France | 273/73 J |
| 2270908 | 12/1975 | France | 273/73 F |
| 513232 | 10/1939 | United Kingdom | 273/73 G |

*Primary Examiner*—Richard C. Pinkham
*Assistant Examiner*—William E. Stoll
*Attorney, Agent, or Firm*—Rosen, Dainow & Jacobs

[57] ABSTRACT

The frame of a tennis racket is comprised of a U-shaped hollow section (1, 1*a*), made according to an injection molding process, open outwardly in the frame plane, which is formed of a connecting bridge (4) and lateral branches (31, 32) and which is rigidly nested into and covered by a countersection (30). Between the two sections (1, 1*a;* 30), reinforcement ribs (15, 49, 50, 51) and the holes (8) for the support sleeves (10) receiving the strings are connected to one of the two sections (1, 1*a;* 30) so as to form a single piece, the reinforcement ribs (15, 49) being attached to the support sleeves (10). In order to obtain a racket having an excellent rigidity to distortion and which is very easy to use in play, reinforcement ribs (15, 49, 50, 51) are attached to the support sleeves (10) and are connected both to the connecting bridge (4) of the U-shaped hollow section (1, 1*a*) and to the lateral branches (31, 32) of said hollow section (1, 1*a*).

11 Claims, 4 Drawing Sheets

TENNIS RACQUET FRAME

This application is a continuation, of application Ser. No. 767,287, filed Oct. 2, 1985, now abandoned.

FIELD OF THE INVENTION

The invention relates to a tennis racquet comprising a hollow section of outwardly open U-shaped profile manufactured by injection molding methods. The hollow section in tun comprises a connecting bridge in which bores for the passage of the strings therethrough are arranged, which connecting bridge is joined to a pair of lateral branches which define an inner space, in which reinforcement ribs are arranged. The inner space is closed by form-locking of a counter-section in which bores for passage of strings are likewise arranged, which bores communicate with the bores of the hollow section.

BACKGROUND OF THE INVENTION

A known tennis racquet is disclosed in U.S. Pat. No. 4,194,738. The hollow section with U-shaped profile shown therein is not provided with reinforcement ribs in the inner space. The reinforcement ribs are instead formed on the middle bridge of the counter-section inserted in the hollow section and supported on the base of the connecting bridge of the hollow section with U-shaped profile. The object of this expedient is the transmission of the forces generated during stringing onto the hollow section. A disadvantage of this known racquet is that the reinforcement ribs formed as concentric, circulating ribs on the counter-section act such that the racquet head is only slightly stable with respect to distortion, because the concentric, continuous rib loosely adjoining the inner surface of the connecting bridge of the hollow section allows relatively large twisting of the racquet head. A further disadvantage is that a small bending resistance and a poor damping property are obtained.

Moreover, the known tennis racquets suffer from detrimental weight distribution because they are considerably top heavy. The hollow section of U-shaped profile is constructed with the same thickness over the entire racquet head, which leads to the top of the tennis racquet being especially heavy, causing the above-described top-heaviness and impeded play.

The hollow section of U-shaped profile arranged in the area of the racquet head converges in a double-T profile in the area of the handle. Injection molding technology can produce such a double-T profile only if corresponding lateral sliders are used, which leads to increased manufacturing expenditures and therefore a higher cost for these tennis racquets. Moreover, a disadvantage encountered is that handles with only one and the same thickness can be produced in the mold. Also, it is not possible to employ replaceable inserts by means of which handles of different thicknesses can be produced. Different handle thicknesses can be achieved in this known tennis racquet only by molding a multi-sided handle section on the double-T section, which is again encircled by a corresponding cover strip. This gives rise to the disadvantage that the handle is made of different materials, thereby raising the possibility of joinder problems.

In French Patent No. 2270908 another tennis racquet frame made by injection molding techniques is disclosed. This frame comprises two assembled half shells which are superimposed to grip each other in an overlapping manner and are connected to each other. The profile of this tennis racquet does not comprise an outwardly open hollow section of U-shaped profile, resulting in the disadvantage of poor bending resistance, poor warping resistance, and poor damping action.

SUMMARY OF THE INVENTION

The object of the invention is to improve the tennis racquet disclosed in U.S. Pat. No. 4,194,738 so that for the same or lower manufacturing costs, a racquet with improved mechanical properties, including improved warping resistance, bending resistance, and damping action, is produced.

This object is achieved according to the invention by connecting the reinforcement ribs fastened to the support sleeves to both the connecting bridge and the lateral branches of the hollow section.

An essential feature of the invention is also that the reinforcement ribs are integrally connected to the U-section and to the support sleeves, in which the bores for passage of the strings therethrough are formed. For this reason, the stress loads are no longer, as is the case in the racquet of U.S. Pat. No. 4,194,738, transmitted to the U-section by way of the counter-section and a reinforcement rib connected to the counter-section, but rather the U-section itself now serves to directly distribute the loads in the direction of the strings. Improved bending resistance and warping resistance results from the reinforcement ribs being integrally formed with the support sleeves. The support sleeves and reinforcement ribs thus constitute load-transmitting elements in the hollow section of U-shaped profile.

According to a particularly advantageous embodiment, the reinforcement ribs are arranged to extend from the support sleeves in a stellate pattern and are connected with both the connecting bridge and the lateral branches.

By constructing a tennis racquet in accordance with the invention, excellent static and dynamic properties can be achieved In particular, with regard to load transmission onto the ball, a self-damping (post-vibration action), a torsional elasticity (warping resistance), and a fatigue strength when strung are achieved in a racquet according to the invention which have been hitherto achieved only in substantially more expensive racquets manufactured by laminated plastic methods and reinforced in places with graphite inserts. In accordance with these known methods, resin-impregnated glass fiber roving is wound around a tube, and during the winding process graphite and other inserts are introduced. The thus-manufactured roving is placed in a closed mold, whereupon the tube is inflated, so that the synthetic resin plastic layer adjoins the heated mold and is hardened. In tennis racquets of this type finishing costs, including grinding, deburring, smoothing, lacquering, and boring of the string holes, constitute 60% of the total manufacturing costs. The cost of such a known tennis racquet with excellent play characteristics is generally three to four times the manufacturing cost. In contrast, a racquet made in accordance with the invention and with equally good static and dynamic properties (i.e. bending resistance, warping resistance, and fatigue strength) can be manufactured at substantially reduced cost.

In accordance with a preferred embodiment, the reinforcement ribs and the support sleeves extend near the front surfaces of the U-section of the hollow profile, thereby defining an inner space of the hollow section in which the counter-section is inlaid, the counter-section having lateral surfaces of acute profile which cover the front surfaces of the U-section. This produces a visually complete appearance of the racquet head whereby it is possible to form the counter-section in a different color than the U-section. By inserting the counter-section in the inner space of the U-section, the string knotting is optimally protected. A smooth transition is achieved by means of the acutely profiled lateral surfaces of the counter-section overlying the front surfaces of the U-section, by means of which the edges of the hollow section itself are protected against damage.

To meet high stability requirements, the counter-section can be connected to the U-section of the hollow section in the area of its acutely profiled lateral surfaces by a composition of matter. Such a connection can be achieved by ultrasonic welding or by vibrational jig welding. Also, a gluing of the respective parts is possible.

A complete protection of the string knotting is achieved by providing the counter-section with a circuitous locking groove which is defined by opposing lateral locking lips, behind which an elastically deformable protective strip is snapped which serves to cover the string knots. In this way the entire peripheral surface of the racquet head is protected against damage and the visual appearance is optimal in that the knotting is no longer visible.

It is preferable that the flexional section modulus of the hollow profile in the area of the racquet head be reduced as compared to the flexional section modulus in the remaining areas. The top of the racquet head comprises a U-section of smaller width and smaller lateral height as compared to the U-section in the remaining areas of the racquet head. By means of the modulation of the dimensions of the U-section of the racquet top in comparison to the remaining areas of the racquet head, the tennis racquet can be adjusted to be top-heavy or handle-heavy.

It is known that the largest flexional and torsional loads act in the center area of the racquet. For this reason, in accordance with another preferred embodiment of the invention, in the center area of the racquet two U-sections with reinforcement ribs molded therein are integrally connected to the circulating hollow section which defines the racquet head, whereby the U-sections converge in the handle of (( the racquet and are integrally joined to the multi-sided section of the handle. The corresponding integral connection is carried out in the casting form with the help of laterally directed sliders, which are controlled by the injection molding or casting processes.

It is significant that the handle of the racquet comprises a multi-sided, approximately round cant section which is provided with a central bore. The longitudinal axis of the bore is directed parallel to the longitudinal axis of the racquet, so that the handle can be directly molded in the injection molding form by means of the face of the inwardly traveling slider which enters the central bore. This gives an optimal connection of the two U-sections and a heavily-loaded junction. A further advantage is that by means of interchangeable insertion in the injection molding form, the diameter of the cant section can be directly changed, so that it is possible to fabricate a racquet with a predetermined handle thickness in the form in one work cycle. Therefore, a desired handle thickness can be obtained without injection molding of an additional handle piece or other measures.

In accordance with the invention the hollow section can be simply fabricated by injection molding methods. The counter-section and the cover portion can be manufactured by extrusion. Further, it is important that a high-density, thermoplastic plastic be employed as the material for the injection-molded hollow section, the plastic having 20–40 wt. % of admixed carbon fibers. In addition to the admixture of carbon fibers, glass fibers can be admixed, e.g. the plastic may include 20% glass fibers and 20% carbon fibers. The limits of the admixture proportions are variable and can be adjusted depending on the desired final strength and the required manufacturing costs. In the injection molding form inserts can be embedded for additionally reinforcing the center area of the racquet.

BRIEF DESCRIPTION OF THE DRAWINGS

The preferred embodiments of the invention will now be described in detail with reference to the following drawings wherein.

Figure 1:
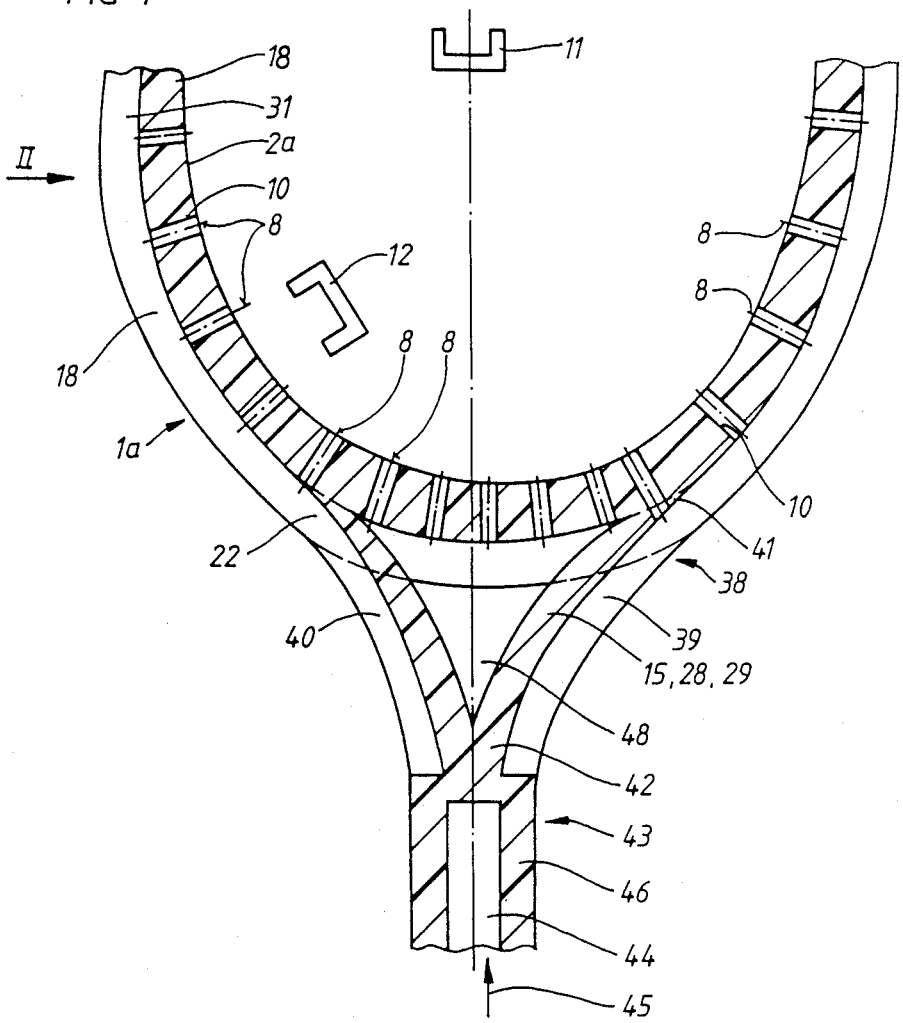
FIG. 1 is a horizontal partial section of the tennis racquet of the invention taken along the section I—I depicted in FIG. 2
Figure 2:
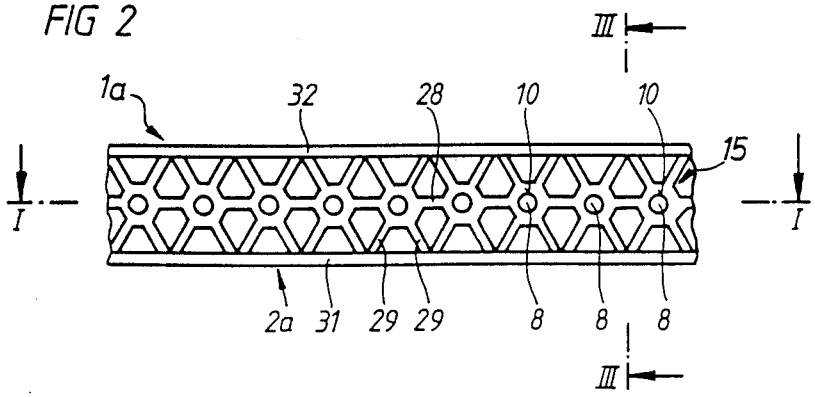
FIG. 2 is a side view of the hollow section with U-shaped profile taken along the direction of arrow II in FIG. 1.
Figure 3:
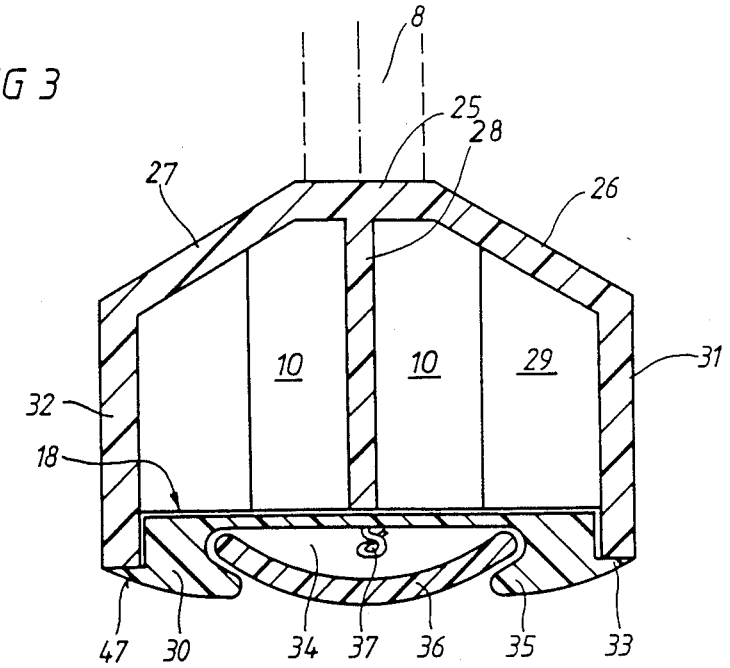
FIG. 3 is a section taken along line III—III in FIG. 2 showing the hollow section with inserted counter-section and protective strip.

The hollow section 1*a* depicted in FIGS. 1–3 is comprised of a U-section 2*a*, which according to FIG. 3 has a ridge-shaped profile.

A bridge part 25, horizontally disposed in FIG. 3, is integrally connected to two bridge parts 26, 27 disposed at an angle with respect to the plane of bridge part 25. The bridge parts are in turn integrally connected to lateral branches 31, 32 disposed substantially perpendicular to bridge part 25.

In accordance with FIG. 1, the reinforcement ribs 15, which are constructed within the U-section, are integrally formed with the material of U-section 2*a*. FIGS. 1 and 3 depict support sleeves 10 which are connected to the inner surface of the middle bridge part 25 and extend outwardly, the outer surface of each support sleeve 10 having a plurality of reinforcement ribs extending laterally therefrom in a stellate pattern (see FIG. 2). The support sleeves 10 spaced apart circumferentially along the head part are connected along the longitudinal axis (section I—I in FIG. 2) by means of the middle ribs 28, while on either side of the longitudinal axis the side ribs 29 are arranged so that each side rib 29 connects a support sleeve 10 with one of the lateral branches 31, 32. Four side ribs 29 and two middle ribs 28 are circumferentially distributed about each support sleeve 10, with each side rib 29 coming together in the area of the inner wall of one of the lateral branches 31, 32 with a side rib connected to an adjacent support sleeve 10.

The interstitial spaces between the reinforcement ribs 28, 29 correspond to the spaces occupied by the sliders in the injection molding form.

FIG. 1 is a horizontal section through the middle ribs 28, showing that the support sleeves 10 (sectioned) form bores 8 for threading the racquet strings therethrough. The diameter of the bores 8 is selected so that it is smaller than the width of bridge part 25 (see FIG. 3).

The racquet head is formed by the round or looped-shaped and enclosed section 2*a*. In the area of the head-handle junction 41 two U-sections 39, 40 are formed integrally connected to U-section 2*a*. In this way the center area 38 of the racquet is formed, with a V-shaped opening formed at the midpoint. The two U-sections 39, 40 likewise have internally arranged reinforcement ribs 15 of the type previously described in connection with FIGS. 2 and 3. The support sleeves 10 with the holes 8 formed therein as shown in FIG. 2 are absent from sections 39, 40.

The U-sections 39, 40 converge at the junction with the handle 43 and are there integrally connected with the canted section 46 of the handle 43. The canted section 46 has an approximately round six-to-ten-sided profile, whereby the molding of the canted section 46 in the injection molding machine is carried out by sliding the slider (not shown) in the direction of arrow 45 to form the central bore 44.

Figure 5:
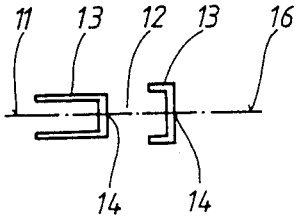
FIG. 5 is a schematic illustration of the varying cross-sectional dimensions of the U-section.

The section modulus of the hollow section 1*a* is schematically depicted in FIGS. 1 and 5, which show that the section modulus 11 is negligible at the peak of the racquet head as compared to the section modulus 12 in the remainder of the hollow section 1*a*. This transition takes place in a continuous manner such that the U-section used, which is symmetrical relative to the axis of symmetry 16 (FIG. 5), has different branch lengths 13 and bridge widths 14.

The reinforcement ribs 15, between which the support sleeves 10 are formed with bores 8 therethrough, extend proximal to the front surfaces of lateral branches 31, 32 (see FIG. 3). In the inner space 18 between the jutting portion of lateral branches 31, 32 of the hollow section a counter-section 30 is inserted, the acutely profiled lateral portions 33 of which overlie the corresponding front surfaces of lateral branches 31, 32. The lateral portions 33 have outer surfaces 47 of predetermined radius which extend to two opposing groove lips 35, between which a locking groove 34 is formed for receiving a protective section 36. The protective section comprises an elastic strip 36 which is flexed to pass between groove lips 35, after which the bowed strip 36 is form-locked into place in groove 34. In this way the string knots 37 are optimally protected and no longer visible from the outside.

In counter-section 30 bores 5 (not shown in FIG. 3) are formed which communicate with bores 8 of U-section 2*a*.

FIGS. 4 and 6–9 show modifications of the preferred embodiment depicted in FIGS. 1–3.

FIGS. 6–9 illustrate a hollow section 1, again comprising a U-section 2, which can be coupled with the counter-sections 3 of different construction shown in FIGS. 4 and 6–9.

Figure 6:
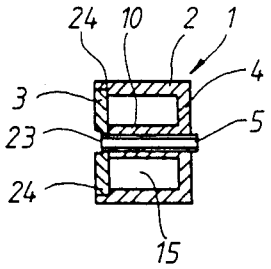
FIG. 6 is a sectional view of the embodiment of the hollow section wherein the support sleeves are integrally connected with the U-section.

The embodiment shown in FIG. 6 has a connecting bridge 4 of the U-section 2 which is integrally formed with the support sleeves 10. The support sleeves 10 have an inside diameter which is sufficiently large to allow the bores 5, which may but need not be integrally formed with the counter-section 3, to be inserted therein. For constructions of this type, injection molding techniques are troublesome since the bores 5 for passage of the strings must be kept clear of overflow from the mold in order to ensure easy and quick threading of the strings.

In counter-section 3 a recess 23 is provided for receiving the string so that the strings nestled therein on the outer circumference of the racquet are protected against mechanical damage.

Figure 7:
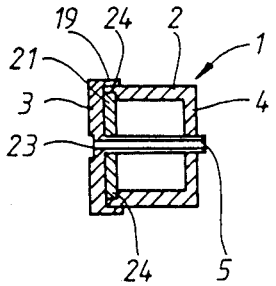
FIG. 7 is a sectional view of the embodiment of the hollow section according to which the strings are supported in a novel way.

FIG. 7 shows another possibility such that support sleeves need not be employed. In this embodiment support for the bores 5 is provided by the insert 21, which is seated in offset 24 formed in the lateral branches of U section 2*a*. Plastic spraying has the advantage that reinforcements and/or high-quality plastic material can be placed where the transmission of load occurs. Normally this high-quality plastic with or without reinforcement has a higher weight so that the weight of the entire racquet can be reduced because of this.

Figure 8:
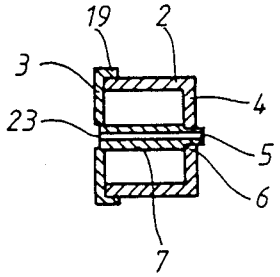
FIG. 8 is a sectional view of a hollow section with a differently constructed counter-section.

FIG. 8 shows the possibility of forming the guide sleeve 7 on a counter-section 3, the support sleeve 7 being supported by form-locking in seat 6 formed in connecting bridge 4.

The support sleeves 7 also have bores 5 for passage of the strings therethrough. The short guide sleeves 9 can be formed (as shown in FIG. 9) so that they can be inserted into the bores 8 in connecting bridge 4 of hollow section 1.

Figure 9:
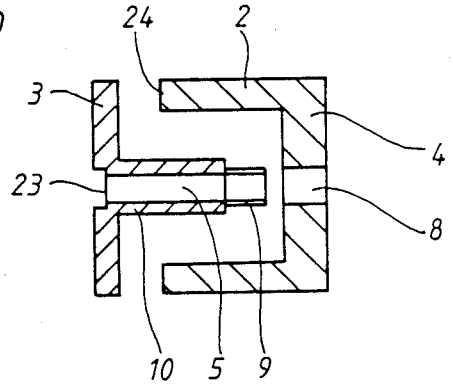
FIG. 9 is an exploded sectional view of a counter-section and hollow section with support sleeve integrally connected to the former.

In accordance with FIG. 9—as well as FIG. 8—The stress-carrying seat 6 can be formed both on the support sleeve 10 and on the connecting bridge 4.

FIGS. 7 and 8 show that the counter-section 3 can also have a U-shaped profile, whereby the edge sheathing 19 overlaps the U-section of hollow section 1, thereby providing protection of the edge.

Figure 4:
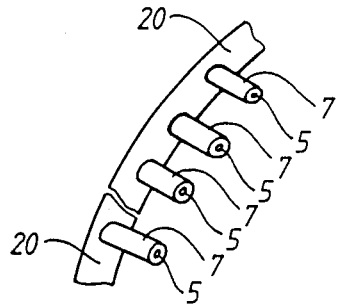
FIG. 4 shows a further embodiment of the counter-section.

FIG. 4 shows that the counter-section can also be formed as a strip 20 having integrally connected guide sleeves 7 extending therefrom, each guide sleeve having a bore 5 formed therein.

Comparison of the embodiments illustrated in FIGS. 3 and 6–9 shows that the U-section 2 can have lateral branches substantially perpendicular to straight connecting bridge 4, whereas in FIG. 3 the connecting bridge 4*a* is ridge-shaped, i.e. five-sided. As a result, the air resistance of the racquet in the plane vertical to the plane of the strings is negligible and the ball does not rebound uncontrollably when it strikes the outer side of the hollow section 1*a*.

The invention shows that it is possible to manufacture a racquet by injection molding methods such that it is equivalent to other racquets from the standpoint of static and dynamic properties, which other racquets are more costly to manufacture.

For reasons of cost it is preferable that the material strengths of the reinforcement ribs 15 of the connecting bridge 4 and the lateral branches 31, 32 be the same.

Figure 10:
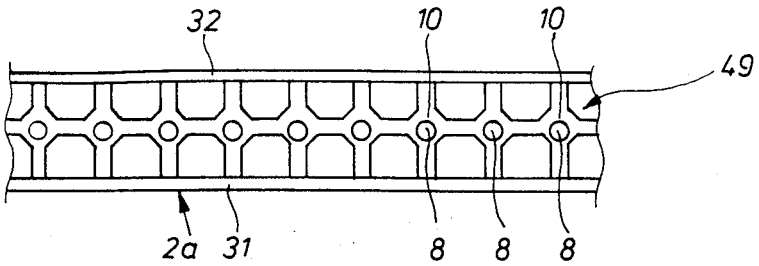
FIGS. 10–12 are side views of three other embodiments of the reinforcement rib arrangement.
Figure 11:
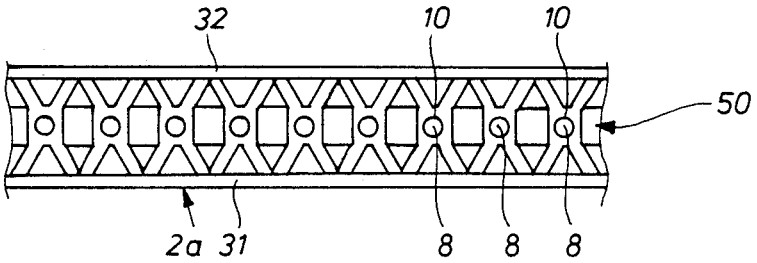
Figure 12:
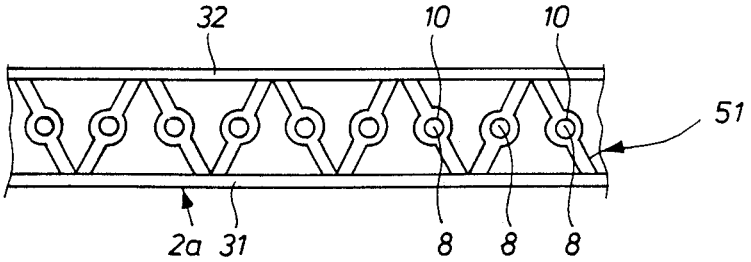

FIGS. 10–12 illustrate further embodiments of the internal structure of the hollow section 1*a*, wherein the elements equivalent to the elements in FIG. 2 are given the same reference numerals.

The construction of the hollow section illustrated in FIG. 10 corresponds to that of FIG. 2 except that the pattern of reinforcing ribs 49 molded in U-section 2a is cross-shaped, rather than stellate. The lateral branches of U-section 2a are connected to each other by way of transverse reinforcing ribs, while the support sleeves are connected by means of reinforcing ribs extending in the longitudinal direction. This results in a grating or grid type arrangement for the reinforcement ribs 49.

FIG. 11 illustrates an X-shaped arrangement of the reinforcement ribs 50, whereas FIG. 12 shows a U-section 2a having a zig-zag-shaped arrangement of the reinforcement ribs 51.

Any of the foregoing variants can be substituted for the embodiment of the hollow section depicted in FIG. 2.

The foregoing description of the preferred embodiment is presented for illustrative purposes only and is not intended to limit the scope of the invention as defined in the appended claims. Modifications may be readily effected by one having ordinary skill in the art without departing from the spirit and scope of the inventive concept herein disclosed.

What is claimed is:

1. A frame for tennis racquet, comprising:

(a) a loop-shaped section having a radially-outwardly-open U-shaped profile and comprising first and second lateral branch portions connected by a connecting bridge portion, a base of said U-shaped profile being formed by said connecting bride portion and first and second legs of said U-shaped profile being formed by said first and second lateral branch portions;

(b) a protective member secured to said lateral branch portions to thereby close off said loop-shaped section, at least a portion of said protective member being removable;

(c) a plurality of spaced hollow support sleeves integrally connected at one end to said connecting bridge portion, said support sleeves being located inside the U-shaped profile spaced along the length thereof and extending radially outward from the bridge portion and spaced from the lateral branch portions and each forming with an aligned hole in the bride portion a bore for receiving a racket string therethrough; and (d) a first plurality of pairs of spaced reinforcement ribs located within the U-shaped profile, each pair comprising a first rib integrally connected to a corresponding one of said support sleeves and said first lateral branch portion and a second rib integrally connected to the same said corresponding one of said support sleeves and said second lateral branch portion, said first and second ribs of each pair of reinforcement ribs extending on opposite sides of said corresponding one of said support sleeves and integrally connecting said support sleeve to the adjacent lateral branch portions.

2. The tennis racquet frame as defined in claim 1, further comprising a plurality of middle ribs located within the U-shaped profile and each integrally connecting adjacent support sleeves.

3. The tennis racquets frame as defined in claim 1, wherein each pair of reinforcement ribs extend along a common plane.

4. The tennis racquets frame as defined in claim 3 wherein the common plane is oblique to the lateral branch portions.

5. The tennis racquet frame as defined in claim 3 wherein the common plane is perpendicular to the lateral branch portions.

6. The tennis racquet frame as defined in claim 1, further comprising a second plurality of spaced reinforcement ribs located within the U-shaped profile, each rib of said second plurality also being integrally connected to a corresponding one of said support sleeves and a lateral branch portion.

7. The tennis racquet frame as defined in claim 6, wherein each support sleeve is integrally connected to a pair of reinforcement ribs of said first plurality and a pair of reinforcement ribs of said second plurality, said ribs of a pair of said first plurality being arranged along a first plane and said ribs of a pair of said second plurality being arranged along a second plane, said first and second planes for one support sleeve intersecting the lateral branch portions at or adjacent the area of intersection of the second and first planes, respectively, of the ribs connected to the adjacent support sleeve.

8. The tennis racquet frame as defined in claim 1, further comprising a second plurality of spaced pairs of reinforcement ribs located within the U-shaped profile, each pair of said second plurality comprising a first rib integrally connected to a corresponding one of said support sleeves and said first lateral branch portion and a second rib integrally connected to said corresponding one of said support sleeves and said second lateral branch portion, said first and second ribs of each pair of reinforcement ribs of said first and second plurality being arranged along a first and second plane respectively and on diametrically opposite sides of said corresponding one of said support sleeves, said first and second planes being mutually oblique and extending generally transverse to the length direction of the U-shaped profile.

9. The frame for a tennis racquet as claimed in claim 8, further comprising a plurality of middle ribs located within the U-shaped profile and each integrally connected adjacent support sleeves.

10. The frame as claimed in claim 1 wherein said reinforcement ribs also extend radially up to the vicinity of the protective member.

11. A frame as claimed in claim 1, wherein said loop-shaped section is made by an injection-molding process out of plastic or reinforced plastic.

* * * * *